US005482226A

United States Patent [19]

Choate

[11] Patent Number: 5,482,226

[45] Date of Patent: Jan. 9, 1996

[54] STORAGE DEVICE WITH SUPPORT CARRIER AND METHOD

[76] Inventor: David A. Choate, 14553 E. 47th Ave., Denver, Colo. 80239

[21] Appl. No.: 215,352

[22] Filed: Mar. 21, 1994

[51] Int. Cl.[6] ..... B65H 75/40

[52] U.S. Cl. ..... 242/588; 242/594; 242/598.3; 206/419; 206/420

[58] Field of Search ..... 242/588, 590, 242/594, 594.3, 596.7, 596.8, 598, 598.3, 598.5, 599, 599.2, 599.3, 599.4, 602, 610.6, 129.6, 129.622; 206/419, 420, 459.5

[56] References Cited

U.S. PATENT DOCUMENTS

| | | | |
|---|---|---|---|
| 2,984,347 | 5/1961 | Kalinchuk | 206/65 |
| 3,931,887 | 1/1976 | Beck | 206/419 |
| 4,022,394 | 5/1977 | Gudde | 242/129.6 |
| 4,172,608 | 10/1979 | Brown, Jr. . | |
| 4,522,348 | 6/1985 | Strout et al. | 242/588 |
| 4,917,323 | 4/1990 | Wing . | |
| 5,064,067 | 11/1991 | McAllister et al. | 206/420 |
| 5,168,999 | 12/1992 | Lee et al. | 206/420 |
| 5,287,965 | 2/1994 | Miller | 206/420 |
| 5,317,491 | 5/1994 | Lee | 206/420 |
| 5,381,899 | 1/1995 | Rabbitt | 206/419 |

FOREIGN PATENT DOCUMENTS

| | | | |
|---|---|---|---|
| 2083292 | 12/1993 | Canada | 206/419 |

*Primary Examiner*—John P. Darling
*Attorney, Agent, or Firm*—Michael A. Capraro

[57] ABSTRACT

A storage device with support carrier for use with electrical cords of the type having electrical sockets, receptacles, lights and the like spaced along the electrical cord and method of using the storage device with support carrier to easily and conveniently store several such electrical cords. The new and novel storage device with support carrier is generally cylindrical in shape with at least one axle removably disposed through the storage device and removably engaged by the support carrier. One or several electrical cords with spaced apart objects thereon can be wrapped onto or unwrapped from the new and novel storage device with support carrier by a single user by simply rotating the storage device around the at least one axle. The new and novel storage device with support carrier provides a convenient, stable, protective, device for storing electrical cords with spaced apart objects thereon.

20 Claims, 3 Drawing Sheets

STORAGE DEVICE WITH SUPPORT CARRIER AND METHOD

BACKGROUND OF THE INVENTION

This invention relates generally to storage devices with support carriers that may be used to store electrical cords and more specifically to a new and novel storage device with support carrier for use with electrical cords of the type having electrical sockets, receptacles, lights and the like spaced along the electrical cord and method of using the storage device with support carrier. The new and novel storage device with support carrier and method is designed to be used with a variety of electrical cords having different types of electrical sockets, receptacles, lights and the like spaced along the electrical cord and particularly designed to easily and conveniently store several such electrical cords.

Electrical cords of the type having electrical sockets, receptacles, lights and the like spaced along the electrical cord are generally packaged on flexible plastic frames with portions of the frame being designed to accommodate each individual socket, receptacle, light or similar device that may be spaced along the electrical cord. Generally, the electrical cord with sockets, receptacles, lights and the like spaced along the electrical cord is easily removed from the frame for use. However, replacing such electrical cords onto the package frame is difficult.

Variations of packaging devices for such electrical cords have been designed as illustrated in the U.S. Pat. No. 2,984,347 issued on May 16, 1961 to Donald W. Kalinchuk. These types of devices are designed so that each individual socket, receptacle, light or other object spaced along the electrical cord is held in place on the frame. When attempting to replace the electrical cord onto such devices, the user must replace each object that is spaced along the electrical cord back into the means provided for holding the individual objects. This task becomes very time consuming and cumbersome. The electrical cord must first be untangled and while holding the device in one hand the electrical cord must then be wound around the device, the user stopping at each spaced object on the electrical cord to manually place that object into its respective holder. Manually placing the object into the proper holder often requires the use of two hands in which case the user must set the device down or enlist the aid of another person to facilitate placing the spaced object into the proper holder. Additionally, these types of packaging devices are limited in the number of electrical cords with spaced apart objects thereon that can be placed on the device.

For another variation of these types of packing devices see generally U.S. Pat. No. 3,931,887 issued on Jan. 31, 1976 to Frederick R. Beck and assigned to McGill Manufacturing Company, Inc. of Valparaiso, Ind. While these types of packaging devices have been satisfactory for initial packaging and shipment of the electrical cord with spaced apart objects thereon, they have limitations which will become apparent when reviewing the applicant's new and novel storage device with support carrier.

Storage devices and organizer have been specifically designed for Christmas lights of the type having spaced apart lights on an electrical cord as illustrated by the U.S. Pat. No. 5,064,067 issued on Nov. 12, 1991 to James D. McAllister, et al. These types of organizers consist of a flat frame with a series of projections on each side of the frame around which the Christmas light cord is wrapped. The user must periodically stop the wrapping process to untangle the electrical cord from lights already in place on the frame. Also, these types of organizers do not protect the light bulbs once they are in place on the frame. If the device is laid on its side, or accidentally dropped, the light bulbs are easily broken and must be replaced. The handle on these types of devices does not provide stability when wrapping or unwrapping the Christmas light cord and does not provide a protective, stable means of storing the device with a Christmas light cord wrapped on the device. These types of organizers are also limited in the number of Christmas light cords that can be placed on each device.

Another type of Christmas light storage device is illustrated by the U.S. Pat. No. 4,917,323 issued on Apr. 17, 1990 to Don Wing. This type of device is cylindrical in nature and designed to be placed over the user's forearm while wrapping the Christmas light cord around the device with the free hand. As with the packaging type devices discussed above, this type of device also requires each light on the electrical cord to be placed into a holding slot on the device. This is a difficult task since one of the user's hands is occupied with holding the device. Again, the user must stop at each spaced object on the electrical cord to manually place that object into its respective holder. As previously discussed, manually placing the object into the proper holding slot often requires the use of two hands in which case the user must set the device down or enlist the aid of another person to facilitate placing the spaced object into the proper holding slot.

These types of devices can be stored in an upright position. However, since the end of the cylinder is smaller in diameter than the discs holding the Christmas light cord, the device is unstable due to the uneven distribution of weight around the cylinder. Thus, this type of device can be easily overturned when stored in a position where the device is placed on the end of the cylinder. If these types of devices are stored on their side, there is a tendency for the device to roll. Uncontrolled rolling can cause breakage of the light bulbs on the Christmas light cord wrapped on the device. These types of devices are also limited in the number of Christmas light cords that can be placed on each device.

When the foregoing prior art devices are used with electrical cords having objects other than lights spaced along the electrical cord, the foregoing problems are compounded. The size or design of other objects that may be spaced along the electrical cord enhance the difficulties of wrapping the electrical cord with spaced apart objects thereon around the prior art devices. Additionally, on those devices having means for holding each individual light, it is nearly impossible to place objects into the holders other than those particular objects for which the holding means is specifically designed.

Variations of support carriers have been designed as illustrated in the U.S. Pat. No. 4,022,394 issued on May 10, 1977 to Lawrence J. Gudde. This type of support carrier is designed to hold a spool of light weight thread on an elongated member. The holder must be placed in a position that is higher than the unwrapping or linear force on the thread. If the holder is placed in a position lower than the unwrapping or linear force on the thread, the spool and elongated member will become dislodged from the holder. This type of holder is designed to be lightweight and is therefore limited in the stress that can be safely applied to it in the unwrapping process. This type of holder also requires an elongated member of a specific configuration, namely one with grooved ends, to securely hold the elongated member in place in the holder.

Another type of support carrier is illustrated in the U.S. Pat. No. 4,172,608 issued on Oct. 30, 1979 to William E. Brown, Jr.. This type of support carrier is designed with a large, heavy base frame that is difficult to move. The base frame is not designed to be attached to the surface on which it rests. Thus, undue linear force in the unwrapping or wrapping process of the spools it supports will cause the device to overturn. This type of device also requires a special horizontal shaft to prevent the horizontal shaft from moving sideways in the device. That is, the horizontal shaft must have a stopping means attached to each end of the shaft.

When the foregoing prior art support devices are used with storage devices designed to hold electrical cords having spaced apart objects thereon, the foregoing problems are compounded. The size or design of the support devices enhance the difficulties of wrapping and unwrapping the electrical cord around a storage device.

SUMMARY OF THE INVENTION

To overcome the before described considerations and problems inherent in and encountered with prior art storage devices and solutions, there is provided by the subject invention a unique storage device with support carrier that may be used with electrical cords of the type having electrical sockets, receptacles, lights and the like spaced along the electrical cord. The new and novel storage device with support carrier and method provides a convenient and easy way to wrap, protect and store electrical cords of the type having electrical sockets, receptacles, lights and the like spaced along the electrical cord.

Applicant's new and novel storage device with support carrier is constructed with a central elongated cylinder that is rotated about a supported axle by turning an end support means. In the preferred embodiment, the central cylinder is formed with cord end retaining means in the form of two hollow half-spheres fixedly attached to each end of the central cylinder, each of the cord end retaining means having a plurality of cord receiving means formed in the outer perimeter of the half-spheres.

The cord end retaining means bear a plurality of indicia in the form of letters or numerals near each of the plurality of cord receiving means. Thus, the plurality of cord receiving means are consecutively labeled to facilitate the wrapping and unwrapping of several electrical cords having objects spaced apart along the length of the electrical cord.

A cord end retaining means is fixedly attached to each end of the central cylinder at a planar apex of the hollow half-sphere. Thus, the open end of the hollow half sphere is oriented away from the body of the central cylinder. An extension means in the form of an extension cylinder is fixedly attached to the inner surface of each hollow half sphere at the planar apex of each hollow half-sphere. End support means in the form of a flat disc is fixedly attached to the opposite end of the extension cylinder and oriented so that the plane of the flat disc is perpendicular to the central longitudinal axis of the extension cylinder.

A central opening is formed through the diametrical center of the planar apex of the cord end retaining means, the extension cylinder and the end support means. The central openings allow at least one axle to be removably disposed through a portion of the new and novel device.

The at least one axle is removably engaged by axle support means located near each end of a support bracket. Axle retaining means are attached near each end of the support bracket between the end of the support bracket and the nearest axle support means. The axle retaining means limit the side to side movement of the axle within the at least one axle support means.

An end of an electrical cord with spaced apart objects is placed into one of the plurality of cord receiving means which holds the electrical cord in place on the new and novel storage device with support carrier. Each cord receiving means is formed by converging curved sides that have an augmented or opened intersection that accommodates the electrical cord without causing damage to the electrical cord. That is, the point at which the converging curved sides meet is slightly larger than the distance between the converging curved sides at a point immediately preceding the intersection of the converging curved sides. Thus, the electrical cord is held in place without damaging the electrical cord by undue pressure or restraint.

The electrical cord with spaced apart objects can then be easily wrapped around the central cylinder by simply turning the end support means which rotates the central cylinder around the at least one axle. The half-spherical shape of the cord end retaining means allows the electrical cords to mold around the spherical outer surface of the cord end retaining means and onto the central cylinder without entanglement. Additionally, the cord end retaining means retains the ends of the electrical cords with spaced apart objects thereon in an orderly fashion and prevents the ends from becoming entangled with the electrical cord or with other electrical cords with spaced apart objects thereon that may also be placed on the new and novel storage device with support carrier. Length of the central cylinder allows the electrical cord with spaced apart objects thereon to be wrapped around the central cylinder in a worm fashion thereby preventing entanglement of the electrical cord. Once the electrical cord with spaced apart objects thereon is wrapped around the central cylinder, the opposite end of the electrical cord is placed into one of the plurality of cord receiving means of the opposite cord end retaining means bearing the same indicia as the plurality of cord receiving means in which the first end of the electrical cord was placed.

The indicia located near each plurality of cord receiving means allows for several electrical cords with spaced apart objects thereon to be place on the new and novel device while maintaining order of placement on the new and novel storage device with support carrier. Thus, several electrical cords having spaced apart objects thereon may be consecutively wrapped on the new and novel storage device with support carrier without entanglement of the electrical cords or the spaced apart objects thereon.

Once the desired number of electrical cords have been wrapped onto the new and novel storage device with support carrier, the storage device may be removed from the support carrier. The device may then be placed on a flat surface standing upright on the end support means which is in the form of a flat disc. Alternatively, the storage device with support carrier may be stored by hanging the carrier in an alternate location from that where the electrical cords with spaced apart objects thereon were wrapped onto the storage device with support carrier.

The end support means in the form of flat discs attached to the ends of the extension cylinder are constructed so that the diameter of each flat disc is larger than the diameter of the half-spheres. Thus, the new and novel storage device with support carrier is very stable when placed upright on the flat discs for storage. Additionally, when the storage device with support carrier is used to wrap and store electrical cords having lights or other delicate objects spaced apart along the length of cord, the larger diameter of the flat discs provides greater protection for those objects. For example, if the storage device happened to be knocked over or dropped, the flat discs would contact the impending surface and would absorb the force of the impact.

Removal of the several electrical cords with spaced apart objects thereon is easily accomplished by removing the opposite end of the electrical cords in reverse order from placement onto the device and rotating the central cylinder by turning the flat disc in the opposite direction as that used to wrap the several electrical cords with spaced apart objects thereon onto the new and novel device.

Applicant's new and novel storage device with support carrier and method in an embodiment is further designed to provide cord end retaining means in the form of a flat disc rather than in a hollow half-spherical configuration. A central opening is formed in the modified cord end retaining means. A plurality of cord receiving means are formed in the outer perimeter of the modified cord end retaining means. The modified cord end retaining means also has a plurality of indicia located near the plurality of cord receiving means.

Accordingly, it is an object and advantage of the invention to provide a new and novel storage device with support carrier and method that conveniently and easily wraps, protects and stores electrical cords of the type having electrical sockets, receptacles, lights and the like spaced along the electrical cord.

Another object and advantage of the invention is to provide a new and novel storage device with support carrier and method that may be conveniently and easily utilized by a single user.

Another object and advantage of the invention is to provide a new and novel storage device with support carrier and method that prevents entanglement of electrical cords of the type having electrical sockets, receptacles, lights and the like spaced along the electrical cord when wrapping or unwrapping such electrical cords front the device.

Yet another object and advantage of the invention is to provide a new and novel storage device with support carrier and method that allows several electrical cords of the type having electrical sockets, receptacles, lights and the like spaced along the electrical cord to be easily and conveniently wrapped onto, protectively stored on and unwrapped from the device.

These and other objects and advantages will become apparent front review of the drawings and front a study of the Description of the Preferred Embodiment relating to the drawings which has been provided by way of illustration only.

DESCRIPTION OF THE PREFERRED EMBODIMENT

Figure 1:
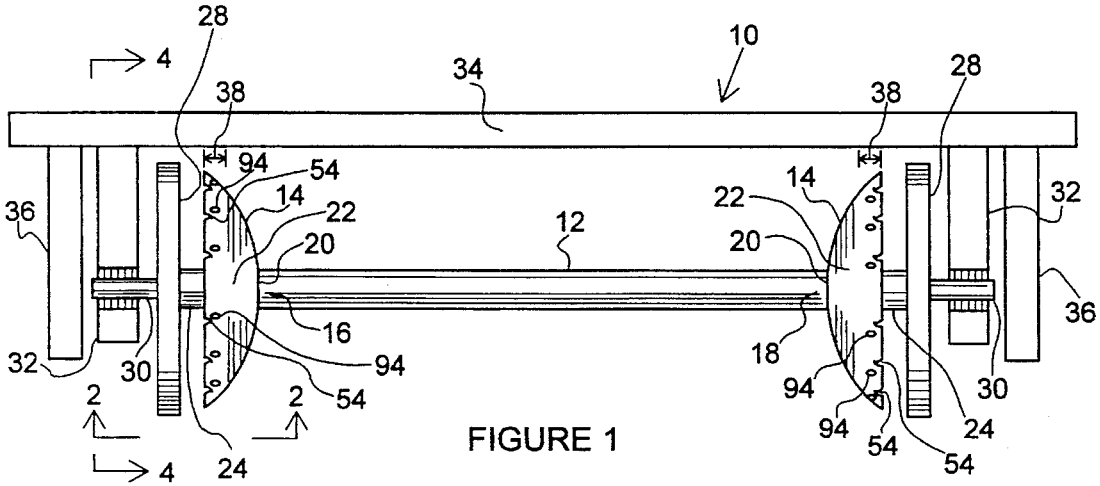
FIG. 1 is a top plan view of applicant's new and novel storage device with support carrier.

Referring to the drawings in general and in particular to FIG. 1 of the drawings, there is shown applicant's new and novel storage device with support carrier shown generally by the numeral 10. The storage device with support carrier 10 has been illustrated in FIG. 1 of the drawings without electrical cords of the type having electrical sockets, receptacles, lights and the like spaced along the electrical cord in place on the applicant's new and novel storage device with support carrier 10 for purposes of clarity. In the Preferred Embodiment the applicant's storage device with support carrier 10 is constructed from a rigid plastic polymer such as acrylic, polystyrene and other plastic polymers known in the art. Other rigid materials may also be used and are considered to be within the spirit and scope of the applicant's invention.

An elongated central cylinder 12 has cord end retaining means 14 fixedly attached to opposite ends 16 and 18 of the central cylinder 12. The cord end retaining means 14 are shaped as hollow half-spheres having a planar apex 20. The outer surface 22 of the cord end retaining means 14 is fixedly attached to the opposite ends 16 and 18 of the elongated central cylinder 12 at the planar apex 20 of the cord end retaining means 14. The planar apex 20 of the cord end retaining means 14 is shown in greater detail in FIG. 2 of the drawings and will be discussed more fully hereinafter.

Still referring to FIG. 1 of the drawings, there is shown a plurality of cord receiving means 54 and a plurality of indicia 94 located in the outer perimeter 38 of the cord end retaining means 14. The configuration of the plurality of cord receiving means 54 will be discussed more fully herein after. A plurality of indicia 94 is located near the plurality of cord receiving means 54 on the cord end retaining means 14. The configuration of the plurality of indicia 94 and the attachment of the plurality of indicia 94 to the cord end retaining means 14 near the plurality of cord receiving means 54 will also be discussed more fully hereinafter.

An extension means 24 is fixedly attached to the inner surface of each hollow half-sphere 14. End support means 28 are fixedly attached to each extension means 24. The extension means 24 shown in the Preferred Embodiment as a cylinder has been designed to illustrate the new and novel desired result. Other configurations may also be used and are considered to be within the spirit and scope of the invention.

At least one axle 30 is removably disposed through a central opening in the end support means 28, the extension means 24, a central opening in the cord end retaining means 14 and the through the elongated central cylinder 12. The disposition of the axle 30 through the extension means 24 and the central openings of the end support means 24 and the cord end retaining means 14 will be discussed more fully hereinafter.

The at least one axle 30 is removably and rotatably engaged by axle support means 32. The axle support means 32 are fixedly attached to a support brace 34. Axle retaining means 36 are fixedly attached to the support brace 34. The axle support means 32, support brace 34 and the axle retaining means 36 will be discussed more fully hereinafter.

Figure 2:
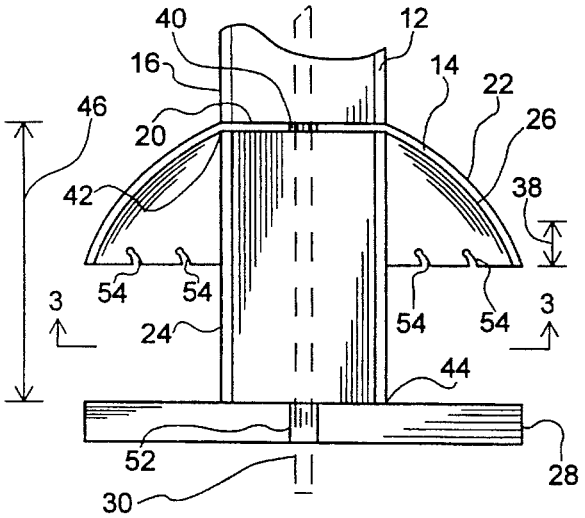
FIG. 2 is a cross sectional side view of an end of applicant's new and novel storage device with support carrier taken along lines 2—2 of FIG. 1.

Referring now to FIGS. 2–10 of the drawings, there will be described in detail applicant's new and novel storage device with support carrier. FIG. 2 is a cross sectional side view of an end of applicant's new and novel storage device with support carrier taken along lines 2—2 of FIG. 1. The cord end retaining means 14 is generally shaped as a hollow half-sphere having a planar apex 20. The outer surface 22 of the cord end retaining means 14 is fixedly attached at the planar apex 20 to opposite end 16 of the elongated central cylinder 12 so that the diametrical center of the planar apex 20 coincides with the central longitudinal axis of the central cylinder 12. Attachment of the outer surface 22 of the cord end retaining means 14 at its planar apex 20 to the end 16 of the central cylinder 12 orients the outer perimeter 38 of the cord end retaining means 14 away from the central cylinder 12.

The outer perimeter 38 of the cord end retaining means 14 has formed therein a plurality of cord receiving means 54. The configuration of the plurality of cord receiving means 54 will be discussed more fully herein after.

In the Preferred Embodiment the central cylinder 12 and cord end retaining means 14 are formed from a rigid plastic polymer such as acrylic, polystyrene and other plastic polymers known in the art. Other rigid materials may also be used and are considered to be within the spirit and scope of the applicant's invention. Also in the Preferred Embodiment, plastic adhesive such as IPS® Corp. Weld on #16, manufactured by I.P.S. Corporation, Gardenia, Calif., is used to attach the cord end retaining means 14 to the central cylinder 12. Other plastic adhesives and other known attaching means may also be used and are considered to be within the spirit and scope of the invention.

A central opening 40 is formed through the planar apex 20 of the cord end retaining means 14. In the Preferred Embodiment the central opening 40 is formed through the planar apex 20 of the cord end retaining means 14 by drilling a hole through the planar apex 20 of the cord end retaining means 14 at the diametrical center of the planar apex 20. Other known methods of forming a central opening may also be used and are considered to be within the spirit and scope of the invention.

Since the cord end retaining means 14 is attached to the central cylinder 12 so that the diametrical center of the cord end retaining means 14 coincides with the central longitudinal axis of the central cylinder 12 as previously described herein, the diametrical center of the central opening 40 automatically coincides with the central longitudinal axis of the central cylinder 12. Thus, the central opening 40 allows the at least one axle 30 to pass through the cord end retaining means 14 into the central cylinder 12 when the at least one axle 30 is removably disposed through the cord end retaining means 14. The at least one axle 30 has been shown in dashed lines in FIG. 2 of the drawings for purposes of clarity.

In the Preferred Embodiment, another cord end retaining means 14 shaped as a hollow half-sphere having a planar apex 20, a central opening 40 and having a plurality of cord receiving means 54 formed in the outer perimeter 38 thereof is fixedly attached in the same manner as previously described herein to the opposite end 18 of the elongated central cylinder 12 but is not shown in FIG. 2 for purposes of clarity. See generally, FIG. 1 of the drawings.

Still referring to FIG. 2 of the drawings, there is shown a first end 42 of an extension means 24 fixedly attached to the inner surface 26 of the cord end retaining means 14 at an area on the inner surface 26 of the cord end retaining means 14 that is directly opposite the attachment point of the central cylinder 12 to the planar apex 20 of the cord end retaining means 14. The extension means 24 is attached so that the central longitudinal axis of the extension means 24 coincides with the central longitudinal axis of the central cylinder 12 and the diametrical center of the central opening 40 in the cord end retaining means 14.

The extension means 24 is designed in the Preferred Embodiment to be hollow thereby allowing the at least one axle 30 to pass through the extension means 24 from the first end 42 to a second end 44 of the extension means 24 when the at least one axle 30 is removably disposed through the extension means 24 so that the extension means 24 encompasses the at least one axle 30 around an outer portion 46 of the at least one axle 30 . The configuration of the extension means 24 as a cylinder approximating the diameter of the central cylinder 12 is shown in the Preferred Embodiment for purposes of illustration only. Other configurations are considered to be within the spirit and scope of applicant's invention.

In the Preferred Embodiment the extension means 24 is formed from a rigid plastic polymer such as acrylic, polystyrene and other plastic polymers known in the art. Other rigid materials may also be used and are considered to be within the spirit and scope of the applicant's invention. Also in the Preferred Embodiment, the extension means 24 is fixedly attached to the cord end retaining means 14 using a plastic adhesive such as IPS® Corp. Weld on #16 or other plastic adhesives known in the art. Other known attaching means may also be used and are considered to be within the spirit and scope of the invention. In another embodiment the extension means 24 is formed continuously with the cord end retaining means 14 by injection molding techniques known in the art.

In the Preferred Embodiment another extension means 24 is fixedly attached to the cord end retaining means 14 on the opposite end 18 of the elongated central cylinder 12 in the same manner as previously described herein but is not shown in FIG. 2 for purposes of clarity. See generally, FIG. 1 of the drawings.

Still referring to FIG. 2 of the drawings there is shown an end support means 28 fixedly attached to the second end 44 of the extension means 24. The end support means 28 is shaped as a flat disc and is attached to the second end 44 of the extension means 24 so that the planar axis of the end support means 28 is perpendicular to the central longitudinal axis of the central cylinder 12. The end support means 28 is also attached so that its diametrical center coincides with the central longitudinal axis of the central cylinder 12 and of the extension means 24.

In the Preferred Embodiment the end support means 28 is formed from a rigid plastic polymer such as acrylic, polystyrene and other plastic polymers known in the art. Other rigid materials may also be used and are considered to be within the spirit and scope of the applicant's invention. Additionally, in the Preferred Embodiment the end support means 28 is fixedly attached to the second end 44 of the extension means 24 using a plastic adhesive such as IPS® Corp. Weld on #16 or other plastic adhesives known in the art. Other known attaching means may also be used and are considered to be within the spirit and scope of the invention. In another embodiment the end support means 28 is formed continuously with the extension means 24 by injection molding techniques known in the art.

A central opening 52 is formed through the end support means 28 at the diametrical center of the end support means 28. In the Preferred Embodiment the central opening 52 is formed through the end support means 28 by drilling a hole through the end support means 28 at the diametrical center of the end support means 28. Other known methods of forming a central opening may also be used and are considered to be within the spirit and scope of the invention.

Since the end support means 28 is attached to the central cylinder 12 so that the diametrical center of the end support means 28 coincides with the central longitudinal axis of the central cylinder 12 and the extension means 24 as previously described herein, the diametrical center of the central opening 52 automatically coincides with the central longitudinal axis of the central cylinder 12, the diametrical center of the central opening 40 in the cord end retaining means 14 and the central longitudinal axis extension means 24 allowing the at least one axle 30 to be removably disposed through the new and novel device and to extend beyond the end support means 28.

In the Preferred Embodiment another end support means 28 having a central opening 52 is fixedly attached to the second end 44 of the extension means 24 in the same manner as previously described herein on the opposite end 18 of the elongated central cylinder 12 but is not shown in FIG. 2 for purposes of clarity. See generally, FIG. 1 of the drawings.

Figure 3:
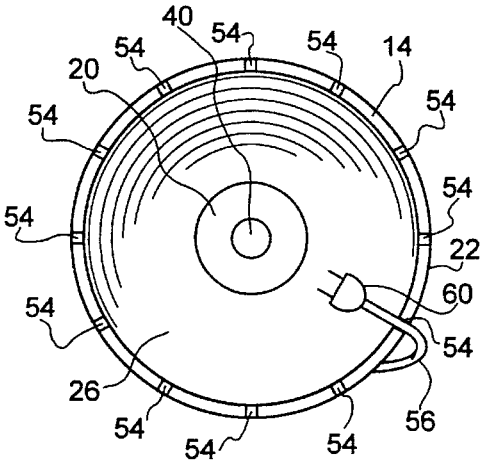
FIG. 3 is an end view of the cord end retaining means of applicant's new and novel storage device with support carrier taken along lines 3—3 of FIG. 2.

Referring now to FIG. 3 of the drawings, there is shown an end view of the cord end retaining means 14 of applicant's new and novel storage device with support carrier device taken along lines 3—3 of FIG. 2. FIG. 3 of the drawings clearly illustrates the positioning of the central opening 40 in the planar apex 20 of the cord end retaining means 14. A plurality of cord receiving means 54 are formed in the outer perimeter 38 of the cord end retaining means 14. The number of the plurality of cord receiving means 54 shown in the Preferred Embodiment as being twelve (12) has been designed to illustrate the new and novel desired result. Other pluralities having different sum totals may also be used and are considered to be within the spirit and scope of the invention. The configuration of the plurality of cord receiving means 54 will be discussed more fully hereinafter.

The plurality of cord receiving means 54 have been designed in the Preferred Embodiment to receive an electrical cord 56 of the type having electrical sockets, receptacles, lights and the like, generally shown by the numeral 58, spaced along the electrical cord 56. An electrical cord such as a string of Christmas tree lights is shown in the Preferred Embodiment for purposes of illustration only. Other electrical cords of the type having electrical sockets, receptacles, lights and the like are considered to be within the spirit and scope of applicant's invention.

An electrical cord 56 of the type described is shown in place in one of the plurality of cord receiving means 54. An end 60 of the electrical cord 56 is oriented toward the inner surface 26 of the cord end retaining means 14 when placed in one of the plurality of cord receiving means 54. The length of the electrical cord 56 having spaced apart objects thereon is oriented along the outer surface 22 of the cord end retaining means 14 and on the central cylinder and is not shown in FIG. 3 of the drawings for purposes of clarity.

Figure 4:
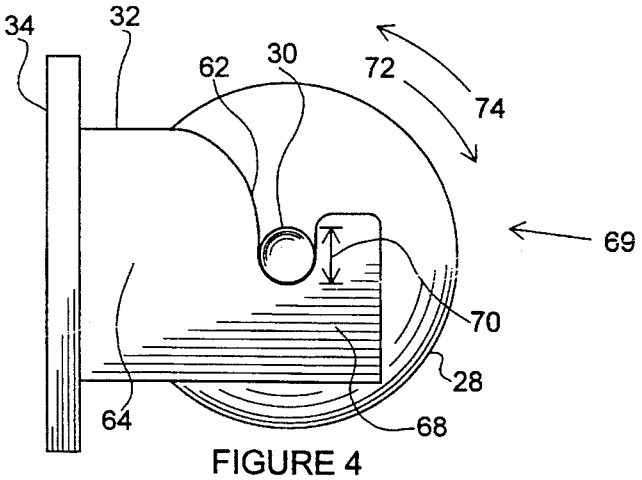
FIG. 4 is an end view of applicant's new and novel storage device with support carrier taken along lines 4—4 of FIG. 1.

Referring now to FIG. 4 of the drawings there is shown an end view of applicant's new and novel storage device with support carrier taken along lines 4—4 of FIG. 1 of the drawings. An axle support means 32 is fixedly attached near an end of the support brace 34. In the Preferred Embodiment the axle support means 32 and the support brace 34 are formed from a rigid plastic polymer such as acrylic, polystyrene and other plastic polymers known in the art. Other rigid materials may also be used and are considered to be within the spirit and scope of the applicant's invention. Also in the Preferred Embodiment, the axle support means 32 is fixedly attached to the support brace 34 using Plastic Weld for Plastic by Lucite. Other plastic adhesives known in the art and other known attaching means may also be used and are considered to be within the spirit and scope of the invention. In another embodiment the axle support means 32 is formed continuously with the support brace 34 by injection molding techniques known in the art.

A notch 62 generally formed in the shape of a J-hook is interposed at the juncture of a inner portion 64 and an outer portion 68 of the axle support means 32. The notch 62 is formed with a cutting instrument of the type known in the art. In another embodiment, the notch 62 is formed in the axle support means 32 when the axle support means 32 is formed by injection molding techniques known in the art.

When the at least one axle 30, having been removably disposed through the new and novel storage device, is removably engaged by the axle support means 32, the weight of the device and gravity force the at least one axle 30 into a low position, shown generally by the numeral 70, of the notch 62. In this position it is difficult to displace the at least one axle 30 from the axle support means 32 by accidental bumping of the device or by forces created on the at least one axle 30 during the wrapping and unwrapping of electrical cords with spaced apart objects thereon onto and off of the new and novel storage device with support carrier. Additionally, since an upsetting force is more likely to come from the side opposite the support brace 34 and toward the support brace 34, as shown by the arrow 69, the J-hook configuration of the notch 62 forces the at least one axle 30 back into the low position 70 in the axle support means 32.

In the Preferred Embodiment another axle support means 32 having a notch 62 is fixedly attached near an opposite end of the support brace 34 in the same manner as previously described herein. See generally, FIG. 1 of the drawings.

Thus, since the at least one axle 30 is removably engaged at each of its ends, disengagement of the at least one axle 30 from the axle support means 32 requires the user to disengage each end of the at least one axle 30 simultaneously from the axle support means 32. The at least one axle 30 is therefore securely engaged in the axle support means 32 allowing the storage device to be easily rotated around the at least one axle 30 by moving the end support means 28 in the direction of the arrows 72 and 74. Rotation of the end support means 28, and thus rotation of the storage device, around the at least one axle 30 facilitates the wrapping of an electrical cord with spaced apart objects onto the storage device with support carrier and will be more fully discussed hereinafter.

Figure 5:
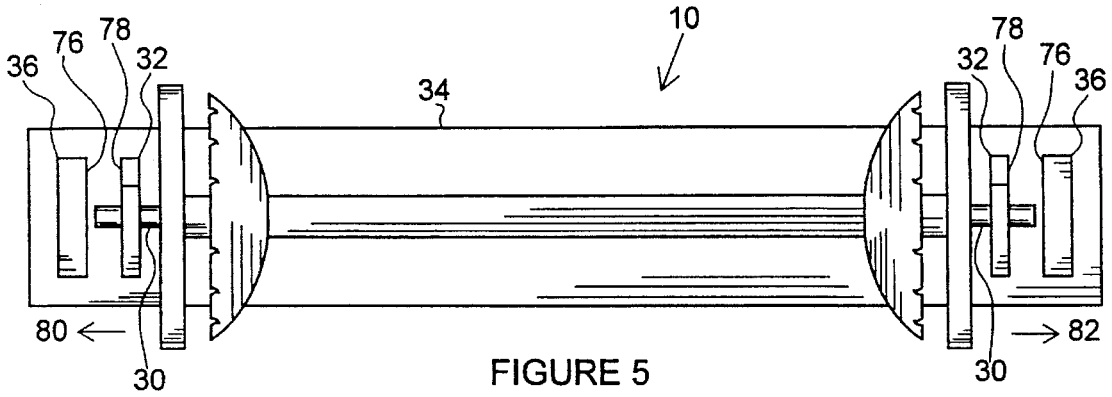
FIG. 5 is a side view of applicant's new and novel storage device with support carrier.

Referring now to FIG. 5 of the drawings there is shown a side view of applicant's new and novel storage device with support carrier shown generally by the numeral 10. An axle retaining means 36 is fixedly attached near each end of the support brace 34 so that the inner surface 76 of the axle retaining means 36 faces the outer surface 78 of the axle support means 32. In the Preferred Embodiment the axle retaining means 36 is formed from a rigid plastic polymer such as acrylic, polystyrene and other plastic polymers known in the art. Other rigid materials may also be used and are considered to be within the spirit and scope of the applicant's invention. Also in the Preferred Embodiment, the axle retaining means 36 is fixedly attached to the support brace 34 using Plastic Weld for Plastic by Lucite. Other plastic adhesives known in the art and other known attaching means may also be used and are considered to be within the spirit and scope of the invention. In another embodiment the axle retaining means 36 is formed continuously with the support brace 34 by injection molding techniques known in the art.

The axle retaining means 36 prevents the at least one axle 30 from becoming displaced from the support carrier if the at least one axle 30 is moved in the direction shown by the arrows 80 and 82. The axle retaining means 36 shown in the Preferred Embodiment as a flat plate has been designed to illustrate the new and novel desired result. Other configurations may also be used and are considered to be within the spirit and scope of the invention.

Figure 6:
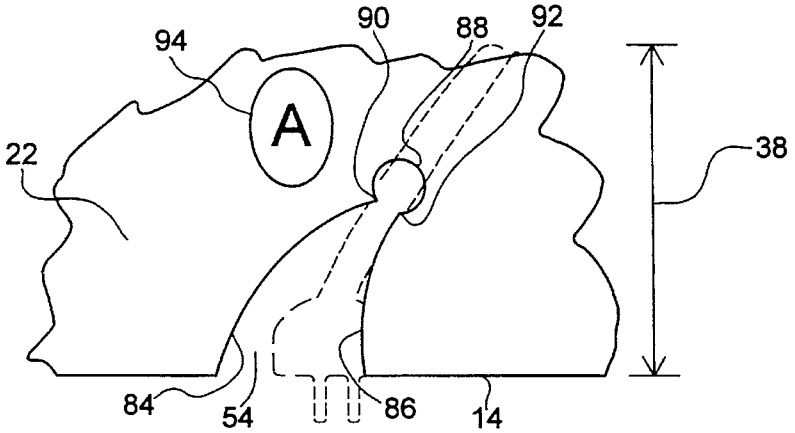
FIG. 6 is an enlarged view of one of the plurality of cord receiving means of applicant's new and novel storage device with support carrier.

Referring now to FIG. 6 of the drawings there is shown an enlarged view of one of the plurality of cord receiving means 54. The cord receiving means 54 is formed in the outer perimeter 38 of the cord end retaining means 14 the entirety of which has not been shown for purposes of clarity. See generally, FIG. 1 of the drawings.

Still referring to FIG. 6 of the drawings, the cord receiving means 54 is formed from two converging curved sides 84 and 86 in the cord end retaining means 14 at the outer perimeter 38 thereof. The intersection 88 of the converging curved side 84 and converging curved side 86 is augmented or enlarged in relation to the points 90 and 92 on the converging curved sides 84 and 86 immediately preceding the intersection 88. Thus, the augmented intersection 88 can hold an end 60 of an electrical cord with spaced apart objects thereon, the end 60 shown as dashed lines in FIG. 6 of the drawings for purposes of clarity, in place without damaging the electrical cord by alleviating undue pressure or restraint on the electrical cord.

The plurality of cord receiving means 54 in the Preferred Embodiment shown as converging sides having an augmented intersection have been designed to illustrate the new and novel desired result. Other configurations may also be used and are considered to be within the spirit and scope of the invention. Also, the plurality of cord receiving means 54 in the Preferred Embodiment are formed in the outer perimeter 38 of the cord end retaining means 14 by removing the unwanted portion of the outer perimeter 38 of the cord end retaining means 14 with a cutting instrument of the type known in the art. In another embodiment, the plurality of cord receiving means 54 are formed in the outer perimeter 38 of the cord end retaining means 14 by injection molding techniques known in the art.

A plurality of indicia 94 is fixedly attached to the outer surface 22 of the cord end retaining means 14 the entirety of which has not been shown for purposes of clarity. The indicia 94 may be in the form of numerals, letters or other indicators of consecutive order. The indicia 94 shown in the Preferred Embodiment as labels bearing a letter have been designed to illustrate the new and novel desired result. Other forms of indicia may also be used and are considered to be within the spirit and scope of the invention. In another embodiment, the indicia 94 are formed on the outer surface 22 of the cord end retaining means 14 near the plurality of indicia 94 by injection molding techniques known in the art.

Figure 7:
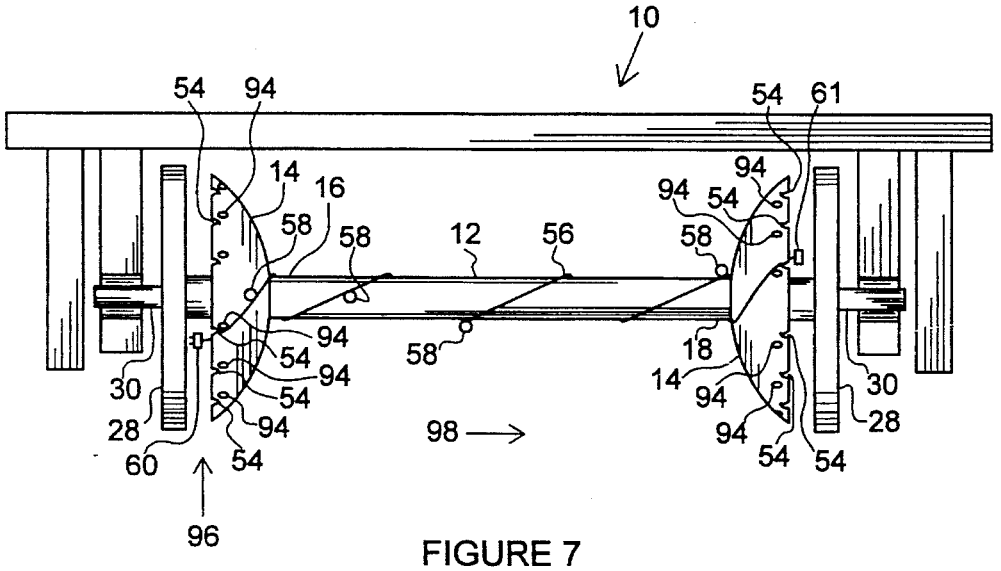
FIG. 7 is a top plan view of applicant's new and novel storage device with support carrier showing an electrical cord of the type having electrical sockets, receptacles, lights and the like spaced along the electrical cord in place on the device.

Referring now to FIG. 7 of the drawings there is shown a top plan view of applicant's new and novel storage device with support carrier, shown generally by the numeral 10, showing an electrical cord 56 of the type having electrical sockets, receptacles, lights and the like, shown generally by the numeral 58, spaced along the electrical cord in place on the device.

An end 60 of an electrical cord 56 with spaced apart objects 58 is inserted into one of the plurality of cord receiving means 54 formed in the cord end retaining means 14 on the end 16 of the central cylinder 12. The indicia 94 that corresponds with the plurality of cord receiving means 54 into which the end 60 of the electrical cord 56 has been placed is noted. The end 60 of the electrical cord 56 is positioned toward the extension means 24 in the direction of the arrow 96.

The end support means 28 is then rotated around the at least one axle 30 as previously described herein to facilitate the wrapping of the electrical cord 56 with spaced apart objects 58 around the central cylinder 12. As the end support means 28 is rotated, the electrical cord 56 with spaced apart objects 58 is advanced along the central cylinder 12 in the direction of the arrow 98 causing the electrical cord 56 with spaced apart objects 58 to be wound around the central cylinder 12 in a worm fashion.

When the electrical cord 56 with spaced apart objects 58 has been completely wrapped onto the central cylinder 12, the opposite cord end 61 of the electrical cord 56 is placed into the cord receiving means 54 located on the opposite end 18 of the central cylinder 12 whose indicia 94 corresponds with the indicia 94 noted previously.

Figure 8:
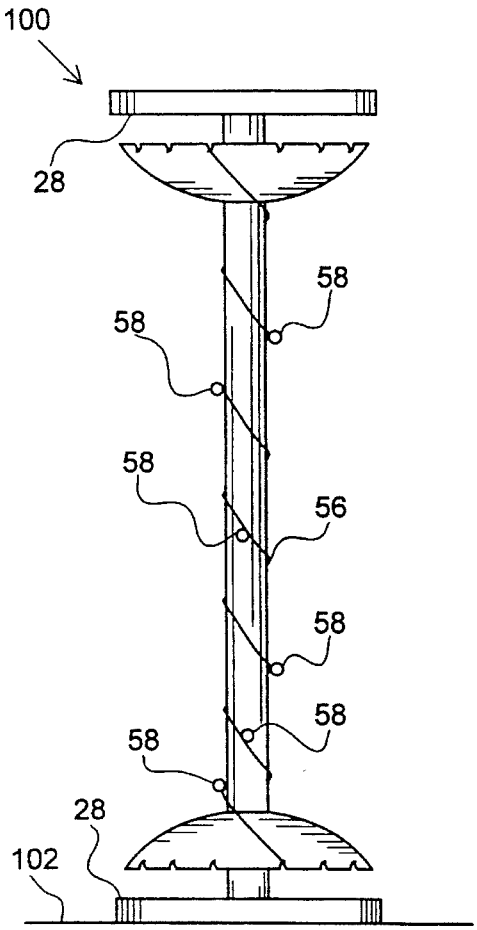
FIG. 8 is an elevational side view of applicant's new and novel storage device in an upright storage position on a flat surface.

Referring now to FIG. 8 of the drawings there is shown an elevational side view of applicant's new and novel storage device shown generally by the numeral 100 in an upright storage position on a flat surface 102. After the electrical cord 56 with spaced apart objects 58 has been wrapped onto the central cylinder 12 of the applicant's new and novel storage device with support carrier, the storage device 100 is removed from the support carrier by disengaging the at least one axle from the axle support means. The at least one axle is then removed from the storage device 100 and the storage device 100 is turned so that an end support means 28 can be placed on a flat surface 102 such as a floor.

The end support means 28 has been designed in the Preferred Embodiment to have a diameter larger than any other part of the storage device 100 thereby providing a stable base on which a full or empty storage device 100 can be placed. Even if the electrical cord 56 with spaced apart objects 58 is wound unevenly around the storage device 100 thereby causing uneven weight distribution, the large diameter of the end support means 28 provides a stable base making it difficult to overturn the storage device 100. Additionally, if the storage device 100 were accidentally bumped or overturned, the end support means 28 would be the first part of storage device 100 to make contact with the impending surface 102. Thus, in the case of a storage device 100 that has one or more electrical cords 56 with spaced apart objects 58 wrapped around it, the objects 58 on the electrical cord 56 are protected from breakage should the storage device 100 be overturned.

Figure 9:
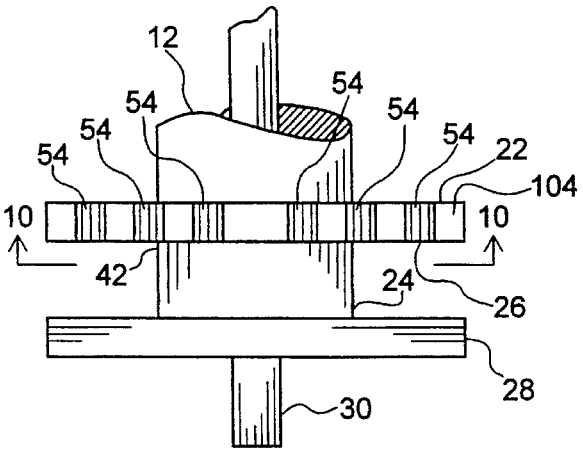
FIG. 9 is a side elevational view of a modification of applicant's new and novel storage device.
Figure 10:
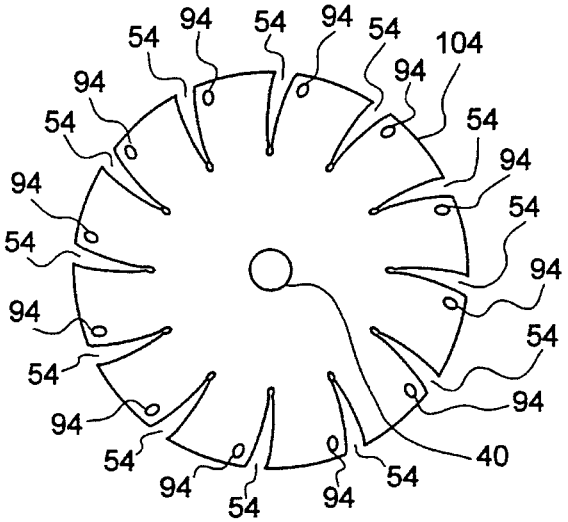
FIG. 10 is an end view of a modification of applicant's new and novel storage device taken along lines 10—10 of FIG. 9.

Referring now to FIGS. 9 and 10 of the drawings there will be described in detail a modification of applicant's new and novel storage device with support carrier. FIG. 9 is a side elevational view of the modification of applicant's new and novel invention. FIG. 10 is an end view of the modification taken along lines 10—10 of FIG. 9 of the drawings.

Referring now to FIG. 9 of the drawings there is shown the modification of applicant's new and novel storage device. In this embodiment a modified cord end retaining means 104 having a plurality of cord receiving means 54 formed in the outer perimeter of the modified cord end retaining means 104 is formed in the shape of a flat disc from a rigid plastic polymer such as acrylic, polystyrene and other plastic polymers known in the art. Other rigid materials may also be used and are considered to be within the spirit and scope of the applicant's invention.

A central opening 40, not shown in FIG. 9 of the drawings but seen in FIG. 10 of the drawings, is formed through the diametrical center of the modified cord end retaining means 104. Still referring to FIG. 9 of the drawings, the outer surface 22 of the modified cord end retaining means 104 is fixedly attached to the central cylinder 12 so that the planar axis of the modified cord end retaining means 104 is perpendicular to the central longitudinal axis of the central cylinder 12 and so that the diametrical center of the central opening 40 coincides with the central longitudinal axis of the central cylinder 12. Thus, since the diametrical center of the flat disc 104 also coincides with the central longitudinal axis of the central cylinder 12 the at least one axle 30 can be removably disposed through the modified cord end retaining means 104 into the central cylinder 12.

In the Preferred Embodiment the modified cord end retaining means 104 is fixedly attached to the central cylinder 12 using a plastic adhesive such as IPS® Corp. Weld on #16 or other plastic adhesives known in the art. Other known attaching means may also be used and are considered to be within the spirit and scope of the applicant's invention.

Also in the Preferred Embodiment, another modified cord end retaining means 104 shaped as a flat disc and having a plurality of cord receiving means 54 formed in the outer perimeter thereof is fixedly attached in the same manner as herein described to the opposite end of the elongated central cylinder 12 but is not shown in FIG. 9 for purposes of clarity.

A first end 42 of the extension means 24 is fixedly attached to the inner surface 26 of the modified cord end retaining means 104 so that the central longitudinal axis of the extension means 24 is perpendicular to the planar axis of the modified cord end retaining means 104 and so that the central longitudinal axis of the extension means 24 coincides with the diametrical center of the central opening 40. Thus, since the central longitudinal axis of the extension means 24 coincides with the diametrical center of the flat disc 104, the at least one axle 30 can be removably disposed through the extension means 24 and through the modified cord end retaining means 104.

In the Preferred Embodiment the extension means 24 is fixedly attached to the modified cord end retaining means 104 using a plastic adhesive such as IPS® Corp. Weld on #16 or other plastic adhesives known in the art. Other known attaching means may also be used and are considered to be within the spirit and scope of the applicant's invention.

Also in the Preferred Embodiment, another extension means 24 is fixedly attached in the manner herein described to the modified cord end retaining means 104 on the opposite end of the elongated central cylinder 12 but is not shown in FIG. 9 for purposes of clarity.

The end support means 28 is formed, oriented, fixedly attached and configured as previously described herein. Similarly, in the Preferred Embodiment another end support means 28 is fixedly attached in the same manner as herein described to the extension means 24 at the opposite end of the elongated central cylinder 12 but not shown in FIG. 9 for purposes of clarity.

Referring now to FIG. 10 of the drawings there is shown an end view of the modified cord end retaining means 104 taken along lines 10—10 of FIG. 9. FIG. 10 of the drawings clearly illustrates the positioning of the central opening 40 through the modified cord end retaining means 104. A plurality of cord receiving means 54 are formed in the outer perimeter of the modified cord end retaining means 104. The number of the plurality of cord receiving means 54 shown in the Preferred Embodiment as being twelve (12) has been designed to illustrate the new and novel desired result. Other pluralities having different sum totals may also be used and are considered to be within the spirit and scope of the invention. The configuration of the plurality of cord receiving means 54 is as previously discussed herein. A plurality of indicia 94 is also fixedly attached to the modified cord end retaining means 104 near the plurality of cord receiving means 54 as previously described herein.

Figure 11:
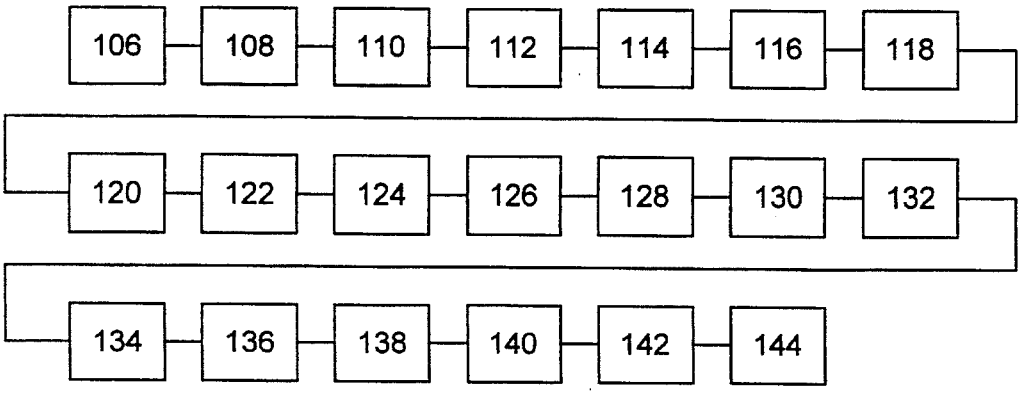
FIG. 11 is a block diagram showing the applicant's new and novel method.

Referring now to FIG. 11 of the drawings there will be described the new and novel method which is used to wrap electrical cords of the type having electrical sockets, receptacles, lights and the like spaced along the electrical cord. The first step in the method, shown by the numeral 106, is to provide at least one electrical cord of the type having electrical sockets, receptacles, lights and the like spaced along the electrical cord, the electrical cord having a first and a second cord end. The second step, shown by the numeral 108, is to provide at least one new and novel storage device with support carrier, the storage device with support carrier having an elongated central cylinder of a fixed length, a cord end retaining means and an opposite cord end retaining means, a plurality of cord receiving means formed in the cord end retaining means and in the opposite cord end retaining means, indicia formed on the cord end retaining means and on the opposite cord end retaining means near the cord receiving means, end support means, at least one axle removably disposed through the device, axle support means, the axle support means being designed to removably engage the at least one axle, a support brace and axle retaining means. The next step, shown by the numeral 110, is to removably attach the at least one storage device with support carrier to a stable surface such as a wall or floor. The next step, shown by the numeral 112, is to removably engage the first cord end of the at least one electrical cord in one of the plurality of cord receiving means of the cord end retaining means. That is, the first cord end of the electrical cord provided is placed into one of the plurality of cord receiving means that is formed in the cord end retaining means. The next step, shown by the numeral 114, is for the user to note the indicia which is near the cord receiving means that the first cord end has been placed into. The next step, shown by the numeral 116, is to rotate the end support means around the at least one axle, thereby wrapping the at least one electrical cord around the elongated cylinder. In the next step, shown by the numeral 118, the user controls the wrap of the at least one electrical cord along the fixed length of the elongated cylinder so that the second cord end of the at least one electrical cord terminates near the opposite cord end retaining means. As the cord is wrapped along the cylinder, it forms a worm like wrap thus preventing entanglement of the electrical cord with spaced apart objects. The next step, shown by the numeral 120, is to removably engage the second cord end of the at least one electrical cord in the opposite cord receiving means whose indicia corresponds to the indicia noted when the user placed the first cord end into a cord receiving means. For example, if the user placed the first end of the electrical cord into the cord receiving means whose indicia was the letter A, the user would then place the second cord end of the electrical cord into the cord receiving means of the opposite cord end retaining means whose indicia was also lettered A. The next step, shown by the numeral 122, is to repeat the steps shown by the numerals 112–120 as necessary to wrap several electrical cords with spaced apart objects thereon on the storage device with support carrier for storage. Thus, if more electrical cords with spaced apart objects thereon are placed on the device, the second electrical cord with spaced apart objects thereon would be wrapped on the device by placing the first cord end of the second electrical cord into an open cord receiving means, B. Steps 114–120 would then be repeated to wrap the second electrical cord with spaced apart objects thereon onto the storage device with support carrier. The second end of the second electrical cord would then be removably engaged in the opposite cord receiving means whose indicia is B. Several cords may be wrapped onto the applicant's new and novel storage device with support carrier in this manner in order from A to L thereby preventing entanglement of the electrical cords with spaced apart objects. The next step, shown by the numeral 124, is to disengage the at least one axle from the axle support means. The next step, shown by the numeral 126, is to remove the at least one axle from the elongated cylinder. And, the next step, shown by the numeral 128, is to place the storage device with electrical cords electrical cord with spaced apart objects wrapped thereon in an upright position on the end support means or to hang the storage device in a location desired by the user.

The electrical cords may be removed from the storage device with support carrier by reversing the method described above. That is, in the next step, shown by the numeral 130, the at least one axle is disposed through the storage device. The next step, shown by the numeral 132, is to rotatably and removably engage the at least one axle in the axle support means. The next step, shown by the numeral 134, is to disengage the second cord end of the at least one electrical cord from the opposite cord receiving means of the opposite cord end retaining means. That is, since the second end of the electrical cord is placed into the cord receiving means last, it is the first end to be removed when unwrapping the electrical cord from the device. The next step, shown by the numeral 136, is to note the indicia near the now empty cord receiving means. The next step, shown by the numeral 138, is to rotate the end support means around the at least one axle so that the at least one electrical cord unwraps from the fixed length of the elongated cylinder. The next step, shown by the numeral 140, is to disengage the first cord end of the at least one electrical cord from the cord receiving means whose indicia matches the indicia noted in the step shown by the numeral 136. The next step, shown by the numeral 142, is to repeat the steps shown by the numerals 134–140 as necessary to unwrap several electrical cords from the storage device with support carrier. When unwrapping several electrical cords with spaced apart objects thereon, it is necessary to begin the unwrapping process with the electrical cord with spaced apart objects thereon that was the last to be wrapped onto the device. The indicia facilitate this process by providing the user with an order in which the electrical cords were wrapped onto the device. For example, if cord receiving means A–L are full, the user knows that the electrical cords with spaced apart objects thereon were wrapped onto the device sequentially beginning with A, then B, then C and so on. Removal of the several electrical cords with spaced apart objects thereon would be accomplished by first removing the electrical cord associated with cord receiving means L. The next electrical cord with spaced apart objects thereon to be removed would be that electrical cord associated with the cord receiving means labeled K. The next electrical cord with spaced apart objects thereon to be removed would be that electrical cord associated with the cord receiving means labeled J, and so on. And the next step, shown by the numeral 144, is to remove the storage device with support carrier from the stable surface if necessary.

From the above it can be seen that the applicant's new and novel storage device with support carrier accomplishes all of the objects and advantages presented herein before. Nevertheless it is within the spirit and scope of the invention that changes in the applicant's basic device may be made and the Preferred Embodiment and the modification shown and described herein have only been given by way of illustration.

Having described my invention, I claim:

1. A storage device with support carrier for use with electrical cords of the type having electrical sockets, receptacles, lights and similar objects spaced along the electrical cord, the electrical cord having opposite cord ends, the storage device with support carrier being designed to easily and conveniently store several such electrical cords, comprising:

a. an elongated cylinder having opposite ends;

b. cord end retaining means having an inner surface and an outer surface, the outer surface being fixedly attached to the opposite ends of the elongated cylinder, the cord end retaining means having a central opening passing from the inner surface to the outer surface, the cord end retaining means also having an outer perimeter;

c. a plurality of cord receiving means formed in the outer perimeter of the cord end retaining means;

d. a plurality of indicia fixedly attached to the cord end retaining means, the plurality of indicia corresponding to the plurality of cord receiving means;

e. extension means having first and second ends, the first end being fixedly attached to the inner surface of the cord end retaining means, the extension means having a hollow portion passing through the extension means from the first end to the second end;

f. end support means fixedly attached to the second end of the extension means, the end support means having a diametrical center, the end support means having a central opening passing through the diametrical center;

g. at least one axle having ends, the at least one axle being removably and rotatably disposed through the central opening of the cord end retaining means, through the extension means and through the central opening of the end support means, the ends of the at least one axle extending beyond the outer surface of the end support means;

h. axle support means having an outer surface, the axle support means removably and rotatably engaging the at least one axle near the ends of the at least one axle;

i. a support brace fixedly attached to the axle support means, the support brace having opposite ends; and j. axle retaining means having an inner surface, the axle retaining means being fixedly attached near the opposite ends of the support brace, the inner surface of the axle retaining means facing the outer surface of the axle support means.

2. The storage device with support carrier as defined in claim 1 wherein the cord end retaining means is a hollow half-sphere having a planar apex, the planar apex of the hollow half-sphere being fixedly attached to the opposite ends of the elongated cylinder, the central opening also being located in the planar apex.

3. The storage device with support carrier as defined in claim 1 wherein the cord end retaining means is a flat disc.

4. The storage device with support carrier as defined in claim 1 wherein the plurality of cord receiving means are converging curved sides, the converging curved sides having an augmented intersection.

5. The storage device with support carrier as defined in claim 1 wherein the plurality of indicia are labels, the labels being removably attached to the cord end retaining means.

6. The storage device with support carrier as defined in claim 1 wherein the plurality of indicia are continuously formed from the cord end retaining means.

7. The storage device with support carrier as defined in claim 1 wherein the cord end retaining means is continuously formed from the extension means.

8. The storage device with support carrier as defined in claim 7 wherein the end support means is continuously formed from the extension means.

9. The storage device with support carrier as defined in claim 1 further comprising a method wherein the storage device with support carrier is used to easily and conveniently store electrical cords of the type having electrical sockets, receptacles, lights and similar objects spaced along the electrical cord.

10. A storage device with support carrier for use with electrical cords of the type having electrical sockets, receptacles, lights and similar objects spaced along the electrical cord, the electrical cord having opposite cord ends, the storage device with support carrier being designed to easily and conveniently store several such electrical cords, comprising:

a. a support brace having opposite ends;

b. axle retaining means fixedly attached to the support brace near the opposite ends of the support brace, the axle retaining means having an inner surface;

c. axle support means having an outer surface, the axle support means being fixedly attached to the support brace near the opposite ends of the support brace, the outer surface of the axle support means facing the inner surface of the axle retaining means;

d. at least one axle removably and rotatably engaged by the axle support means, the at least one axle having an outer segment, the at least one axle also having opposite ends;

e. extension means having first and second ends, the extension means having a hollow portion passing through the extension means from the first end to the second end, the extension means rotatably encompassing the outer segment of the at least one axle allowing the at least one axle extending beyond the first and second ends of the extension means;

f. end support means fixedly attached to the second end of the extension means, the end support means having a diametrical center, the end support means having a central opening passing through the diametrical center, the central opening allowing the at least one axle to pass through the end support means so the opposite ends of the at least one axle extend beyond the end support means;

g. cord end retaining means fixedly attached to the first end of the extension means, the cord end retaining means having an inner surface and an outer surface, the cord end retaining means having a central opening passing from the inner surface to the outer surface allowing the at least one axle to pass through the cord end retaining means, the cord end retaining means also having an outer perimeter;

h. a plurality of cord receiving means formed in the outer perimeter of the cord end retaining means;

i. a plurality of indicia fixedly attached to the cord end retaining means, the plurality of indicia corresponding to the plurality of cord receiving means; and j. an elongated cylinder fixedly attached to the outer surface of the cord end retaining means.

11. The storage device with support carrier as defined in claim 10 wherein the cord end retaining means is a hollow half-sphere having a planar apex, the planar apex of the hollow half-sphere being fixedly attached to the first end of the extension means, the central opening also being located in the planar apex.

12. The storage device with support carrier as defined in claim 10 wherein the cord end retaining means is a flat disc.

13. The storage device with support carrier as defined in claim 10 wherein the plurality of cord receiving means are converging curved sides, the converging curved sides having an augmented intersection.

14. The storage device with support carrier as defined in claim 10 wherein the plurality of indicia are labels, the labels being removably attached to the cord end retaining means.

15. The storage device with support carrier as defined in claim 10 wherein the plurality of indicia are continuously formed front the cord end retaining means.

16. The storage device with support carrier as defined in claim 10 wherein the cord end retaining means is continuously formed from the extension means.

17. The storage device with support carrier as defined in claim 16 wherein the end support means is continuously formed front the extension means.

18. The storage device with support carrier as defined in claim 10 further comprising a method wherein the storage device with support carrier is used to easily and conveniently store electrical cords of the type having electrical sockets, receptacles, lights and similar objects spaced along the electrical cord.

19. A method of trapping and storing electrical cords having a first and a second cord end and of the type having electrical sockets, receptacles, lights and similar objects spaced along the electrical cord on a storage device with support carrier comprising the steps:

a. providing at least one electrical cord of the type having electrical sockets, receptacles, lights and similar objects spaced along the electrical cord, the electrical cord having a first and a second cord end;

b. providing at least one storage device with support carrier, the storage device with support carrier having an elongated central cylinder of a fixed length, a cord end retaining means and an opposite cord end retaining means, a plurality of cord receiving means formed in the cord end retaining means and in the opposite cord end retaining means, indicia formed on the cord end retaining means and on the opposite cord end retaining means near the cord receiving means, end support means, at least one axle removably disposed through the device, axle support means, the axle support means being designed to removably engage the at least one axle, a support brace and axle retaining means;

c. removably attaching the at least one storage device with support carrier to a stable surface;

d. removably engaging the first cord end of the at least one electrical cord provided in one of the plurality of cord receiving means of the cord end retaining means;

e. noting the indicia near the now occupied cord receiving means;

f. rotating the end support means around the at least one axle, thereby wrapping the at least one electrical cord of the type having electrical sockets, receptacles, lights and similar objects spaced along the electrical cord around the elongated cylinder;

g. controlling the wrap of the at least one electrical cord provided along the fixed length of the elongated cylinder so that the second cord end of the at least one electrical cord terminates near the opposite cord end retaining means;

h. removably engaging the second cord end of the at least one electrical cord provided in the opposite cord receiving means whose indicia corresponds to the indicia noted in step (e);

i. repeating steps d–h as necessary to wrap several electrical cords of the type having electrical sockets, receptacles, lights and similar objects spaced along the electrical cord on the storage device with support carrier;

j. disengaging the at least one axle from the axle support means;

k. removing the at least one axle from the storage device; and l. placing the storage device with one or more electrical cords of the type having electrical sockets, receptacles, lights and similar objects spaced along the electrical cord in an upright position on the end support means in a storage location desired by the user.

20. The method as defined in claim 19 wherein the at least one electrical cord of the type having electrical sockets, receptacles, lights and similar objects spaced along the electrical cord is removed from the storage device with support carrier further comprising the steps:

m. disposing the at least one axle through the storage device;

n. rotatably and removably engaging the at least one axle with the axle support means;

o. disengaging the second cord end of the at least one electrical cord provided from the opposite cord receiving means of the opposite cord end retaining means;

p. noting the indicia near the now empty cord receiving means;

q. rotating the end support means around the at least one axle so that the at least one electrical cord of the type having electrical sockets, receptacles, lights and similar objects spaced along the electrical cord unwraps from the fixed length of the elongated cylinder;

r. disengaging the first cord end of the at least one electrical cord provided from the cord receiving means whose indicia corresponds to the indicia noted in step p;

s. repeating steps o–r as necessary to unwrap several electrical cords of the type having electrical sockets, receptacles, lights and similar objects spaced along the electrical cord from the storage device with support carrier; and t. removing the storage device with support carrier from the stable surface if necessary.

* * * * *